United States Patent [19]

Kameshima

[11] Patent Number: 5,004,236

[45] Date of Patent: Apr. 2, 1991

[54] BALANCE SHAFT

[76] Inventor: Makoto Kameshima, 11-17 Miyagidai 2-chome, Funashi-shi, Chiba-pref., Japan

[21] Appl. No.: 233,846

[22] Filed: Aug. 16, 1988

Related U.S. Application Data

[63] Continuation of Ser. No. 31,126, Mar. 30, 1987.

[30] Foreign Application Priority Data

Apr. 2, 1986 [JP] Japan ..... 61-76286
Sep. 5, 1986 [JP] Japan ..... 61-207738

[51] Int. Cl.[5] ..... A63B 53/00

[52] U.S. Cl. ..... 273/80 B; 273/80 C; 273/80.8

[58] Field of Search ..... 273/80 B, 80 C, 80.2, 273/80.4, 80.3, 80.5, 80.6, 80.8, 81 A, 80.9, 80 A, 77 A, 163 R, 163 A, 164

[56] References Cited

U.S. PATENT DOCUMENTS

| | | | |
|---|---|---|---|
| 1,573,708 | 2/1926 | Hoerle | 273/80 B |
| 1,589,297 | 6/1926 | Lard | 273/80 B |
| 1,950,342 | 3/1934 | Meshel | 273/80 B |
| 3,389,046 | 6/1968 | Burress | 273/80.8 |
| 4,319,750 | 3/1982 | Roy | 273/DIG. 7 |
| 4,415,156 | 11/1983 | Jorgensen | 273/81 A X |
| 4,461,479 | 7/1984 | Mitchell | 273/81 A |
| 4,674,746 | 6/1987 | Benoit | 273/81 A |
| 4,725,062 | 2/1988 | Kinney | 273/80 C |

FOREIGN PATENT DOCUMENTS 150548 9/1920 United Kingdom .

*Primary Examiner*—Edward M. Coven
*Assistant Examiner*—William E. Stoll
*Attorney, Agent, or Firm*—Wegner & Bretschneider

[57] ABSTRACT

A balance shaft is comprised of cylindrical members provided inside a golf shaft at appropriate points to give the golf-shaft an ideal whippiness and ensure the club-head makes accurate contact with the ball.

5 Claims, 4 Drawing Sheets

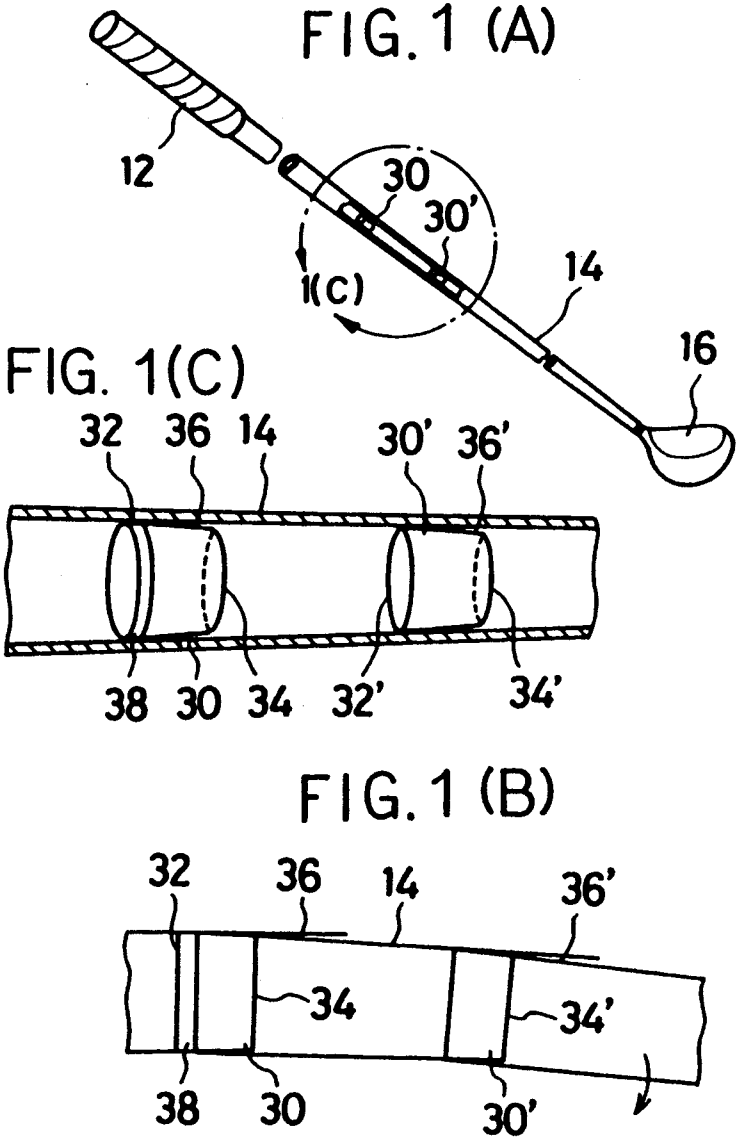
FIG. 1 (A)
16
14
30'
30
1(C)
12
FIG. 1(C)
36'
34'
30'
32'
14
36
34
30
32
38
FIG. 1 (B)
36'
34'
30'
14
36
34
30
32
38
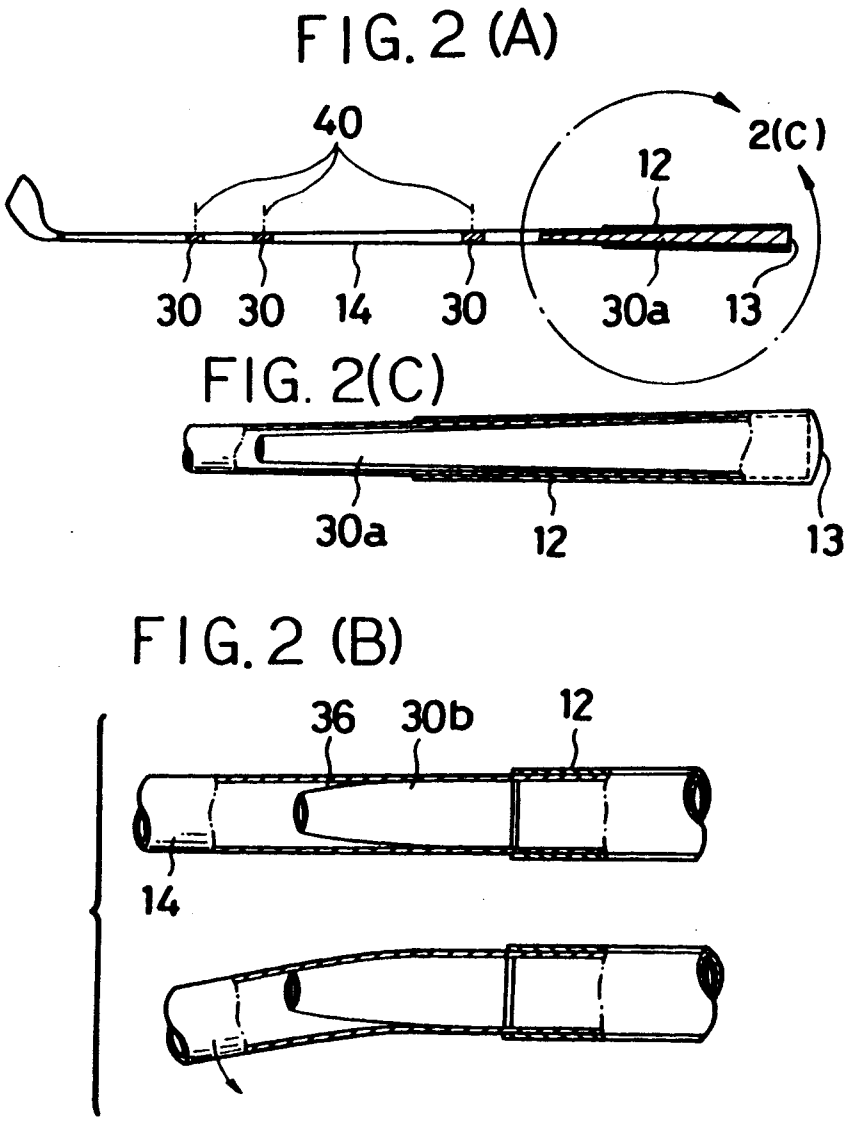
FIG. 2 (A)
2(C)
13
12
30a
30
40
14
30
30
FIG. 2(C)
13
12
30a
FIG. 2 (B)
12
30b
36
14

12
14
16
18

12
14
11
16
18
20

16
18

12
14
16
22
11
18
20

BALANCE SHAFT

This application is a continuation of U.S. application Ser. No. 031,126, filed Mar. 30, 1987.

FIELD OF THE INVENTION

This invention relates to the shaft of a golf club. This invention particularly relates to a balance shaft comprised of cylindrical members provided inside the golf-shaft at appropriate points to give the golf-shaft an ideal whippiness and enable accurate contact with the club-head meat.

BACKGROUND OF THE INVENTION

Golf is considered a difficult game because of the considerable uncertainty about how far and in what direction a golf ball will fly. The cause of this lies in the fact that the ball is forcibly struck by the golf club, which comprises, relatively heavy club-head affixed at one end of a long shaft so that the club-head juts out. In a golf swing, the body forms the axis for a turning action of an object having a length formed by the golf club linked to the arms. Of most important at the moment of impact is the angle formed by the golf club and the straight line formed by the left arm and the left-hand grip portion where the left arm joins the golf club. While describing the body as an axis of rotation, the human body is not a fixed axis which is rotated by a force applied from without, but is instead a movable axis possessing sentient faculties which is autonomously moved in delicate curves for alignment with the golf ball. Similarly, the arm does not form the type of simple swing plane such as is applied by a swing machine. That is, functionally the position of the gold ball is visually ascertained and mental calculations are then undertaken by the golfer to form a mental picture of the swing that is a composite of the club-shaft swing plane and the distance. At this time it is the club-shaft which forms the mental picture of the swing plane. It is considered that the ball can be hit farthest and with accuracy when the tip of the swing plane described by the club-shaft coincides with the center of gravity of the club-head, or the sweet spot. However, notwithstanding that there is always a slight discrepancy between the plane of the club-shaft swing path and the path of the center of gravity of the club-head because of the shape of the golf club, because the swing by a human being is based on his image of the swing path described by the club-shaft, it is not possible to strike the golf ball when the tip of the swing plane coincides with the center of gravity of the club-head.

That is, the club-head is jutted out to maintain a lie (the inclination of the sole of the club-head relative to the club-shaft) and as such it is difficult to have the point of impact, which is at the tip of the swing plane that is described by the club-shaft, coincide with the sweet spot (center of gravity) of the club-head. It is the whippiness or flex of the club-shaft in the course of the swing that removes the slight discrepancy between the plane of the club-shaft path and the path of the center of gravity of the club-head. The whip of the club-shaft during the swing is as shown in FIG. 5. Here, as the club-shaft 14 moves from the top of the backswing A to the beginning of the downswing B, the club-shaft 14, being lighter than the club-head 16, is ahead of the club-head 16 as the club-shaft 16 flexes toward the backswing portion. At position C, the acceleration of the heavier club-head 16 is starting to bring it ahead, and the club-shaft 14 is starting to whip toward the forward part of the swing. In this flexed state, the club-head 16 is turned as it moves through position E to position F. In the transition through position E and F, the club-shaft 14 and the club-head 16 are rolled through 90 degrees, bringing the club-head face into square alignment with the golf ball 11. It is the way the club-shaft whips during this rolling of the club-head that has the most influence on the impact timing of the swing. FIG. 6 is a plane view of the relationship between the center of gravity of the club-head and the whip of the club-shaft during the part of the swing plane in which club-head is rolled to produce optimum impact. FIG. 6B shows the ideal whip of the club-shaft to enable the ball to be struck with the optimum impact. That is, the grip 12, the club-shaft 14 and the center of gravity 18 form a straight line along a line of extension 20 of the club-shaft 14 when the club-shaft 14 is in a non-flexed state, with the center of gravity 18 at the tip of the swing plane described by the club-shaft 14 and wherein even if the center of gravity 18 of the club-head 16 is rotated by b 90 degrees, it does not deviate from the swing plane. (In FIG. 6B, for illustrative convenience, the club-shaft 14 is shown as whipping below the line of extension 20, but the actual whip is a composite of the whip in the horizontal direction relative to the plane of the swing path, and the vertical whip, and is a diagonally downward flex relative to the plane of the swing path.) In this state the impact will be optimum. This optimum impact cannot be achieved if the amount of whip either exceeds or falls short of this ideal whippiness. With reference to FIG. 7 which is a plane view of the relationship between the center of gravity of the club-head and a club-shaft exhibiting excessive whip as it approaches the part of the swing plane in which the club-head is rolled, if the club-shaft 14 whips too much, as shown in FIG. 7B, the toe portion 22 of the club-head 16 will lie on the line of extension 20 extending from the grip 12 down along the club-shaft 14; striking the ball with this portion will produce a hooked shot. FIG. 8 is a plane view of the relationship between the center of gravity of the club-head and a club-shaft exhibiting insufficient whip as it approaches the part of the swing plane in which the club-head is rolled. As shown in FIG. 8B, here, the heel portion 24 of the club-head 16 lies on the line of extension 20 of the grip 12 and club-shaft 14; striking the ball with this portion will have a gear-wheel effect that will result in a sliced shot.

In view of the foregoing, in order to achieve optimum impact, the whip shown in FIG. 6B is necessary, with the sweet spot located on the line of extension of the club-shaft. In order to have the club-shaft whipping as shown in FIG. 6B at the moment of impact, it must be securely fixed to form an angle of around 155 degrees between the straight left arm and the club-shaft. This is also the ideal angle to maintain because when held straight the human wrist joint is prone to impact in the direction in which the ball is sent. With the club-shaft brought into impact in the state in which the grip is maintained at this angle, at the stage of impact the ideal whip such as is shown in FIG. 6B is generated by the momentum stored as the inertial moment of the club-head in its descent in the downswing. The effect of this whip in the follow-through to the swing along the line of flight is to lift the ball and increase the distance of its flight.

It is therefore necessary to limit precisely the whippiness of the club-shaft. Optimum impact cannot be achieved if there is too much whip or if there is too little. Expressed another way, what is difficult golf is the adjustment by the golfer to an optimum whip for the swing so that the club-shaft does not whip excessively or insufficiently; this can also be referred to as the technique of golf.

With conventional golf clubs, in order to impart the ideal whip to the club-shaft and have the sweet spot at the moment of impact located on a straight line extending from the grip, it has been necessary to strike an optimum balance among four conditions: the speed of the downward swing, the weight of the club-head, the degree of elasticity, and the lie angle. However, because the weight of the club-head, the degree of elasticity, and the lie angle have already been fixed during the manufacture of the golf club, it has been necessary for the golfer to produce the ideal whip by regulating the speed of his swing. It is not, however, easy to consistently produce this ideal whip of the club-shaft. Even with respect to those persons who are considered to have adequately mastered the technique of producing it, there still remain elements of uncertainty that can cause variation in the degree of imparted whip, such as physical condition, atmospheric temperature and the like. In fact, ordinary golfers can only be described as lucky if they, unable to find a golf club which matches their strength, happen to purchase a club which results in the requisite balance being achieved between their swing speed and the weight of the club-head, the degree of elasticity, and the lie angle for producing the ideal club-shaft whip. Instead, the majority are obliged to use unsuitable clubs.

SUMMARY OF THE INVENTION

It is an object of this invention to provide a balance shaft of simple construction which enables the optimum whip to be consistently produced at the impact of the club-head.

It is also an object of this invention to provide a balance shaft which enables the optimum whip to be consistently produced at the impact of the club-head, comprising affixing in the interior of the club-shaft cylindrical members which are formed of high-tensile, non-elastic members and in which the circumference of one end of the cylindrical members differs from the circumference of the other end, thereby providing sufficient elasticity within a limited range while constraining the elasticity at predetermined critical points.

The balance shaft according to this invention has one or more cylindrical members affixed at appropriate points in the hollow interior of the shaft of a golf club.

BRIEF DESCRIPTION OF THE DRAWINGS

FIGS. 1(A–C) show a perspective partially cutaway view of the overall balance shaft and of enlarge details thereof;

FIGS. 2(A–C) and 3 are perspective views of other embodiments of the balance shaft;

DESCRIPTION OF THE PREFERRED EMBODIMENTS

Figure 5:
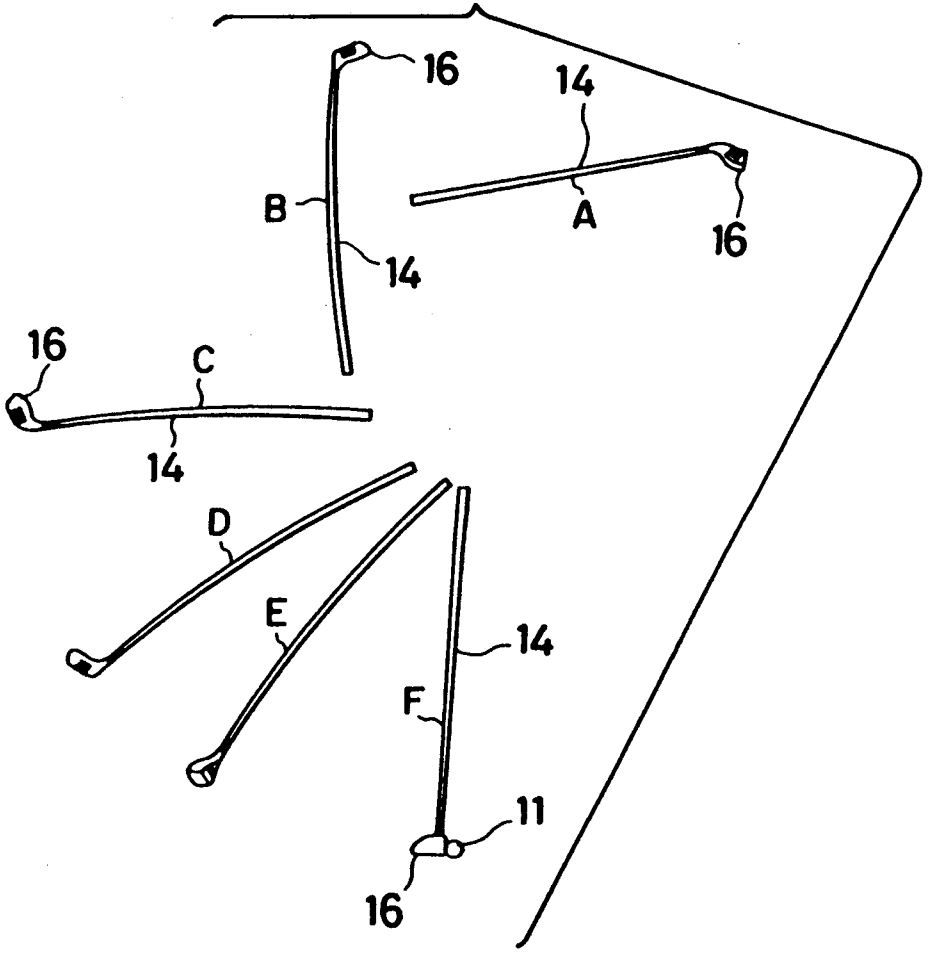
FIG. 5 is a plane view of the whip of a club-shaft during the golf swing.

Embodiments of the balance shaft according to the present invention will now be described hereinbelow, with reference to the accompanying drawings.

With reference to FIG. 1 which shows a perspective partially cutaway view of the overall balance shaft and of enlarged details thereof, a balance shaft 10 comprises cylindrical members 30 fixed therein at appropriate positions.

The cylindrical members 30, 30′ are high-tension, non-elastic members formed so that the diameter of one end of the members differs slightly from the diameter of the other end. That is, the surfaces of the cylindrical members have a slight taper (the difference 36, 36′). The cylindrical members 30, 30′ are fixed inside the club-shaft 14 with the smaller diameter end thereof toward the club-head 16 end. The end of the cylindrical members 30, 30′ toward the grip 12 end has a non-tapered portion 38. This portion 38 is bonded by adhesive or the like to the inside of the club-shaft 14 to enable the cylindrical members 30, 30′ to be fixed very securely in the club-shaft 14. The cylindrical members 30, 30′ are preferably as light as possible; if strength tolerances allow, the cylindrical members may be hollow.

As shown in FIG. 1B, the whippiness of a club-shaft 14 is limited to be within the range of the difference 36 between the circumference of the ends 32, 32′ of the cylindrical members 30, 30′, which are affixed in the interior of the club-shaft 14, and the circumference of the other ends 34, 34′ of the cylindrical members 30, 30′. That is, at the portion where the cylindrical members 30, 30′ are fixedly provided in the club-shaft 14, the club-shaft 14 cannot whip by more than the difference 36, 36′ between the circumference of the ends 32, 32′ of the cylindrical members 30, 30′ and the circumference of the other ends 34, 34′. By thus suitably limiting the whip of each portion of the club-shaft 14 by the difference 36, 36′ in the cylindrical members 30, 30′, the overall whip of the club-shaft can be adjusted to the aforementioned ideal whippiness.

FIG. 2 shows another embodiment of the balance shaft according to this invention. In this embodiment, the cylindrical members 30 are fixedly provided within the club-shaft 14 at the kick-point 40 (described hereinbelow) and grip 12 portion. The cylindrical member 30 provided at the grip 12 portion is longer than the cylindrical member 30 provided at the kick-point 40 portion, limiting the overall whip of the grip 12 portion.

Figure 3:
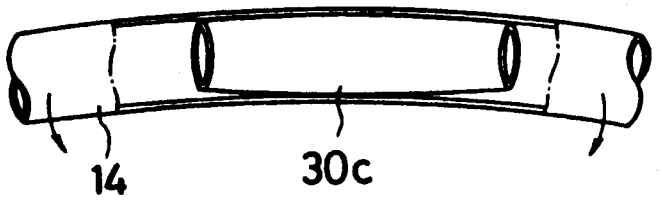
Figure 4:
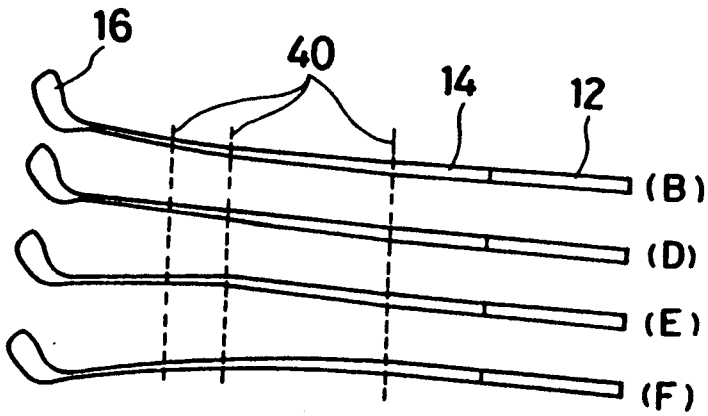
FIG. 4 is a plane view showing the whip of the kick-point 40 of the club-shaft 14.
Figures 6, 7:
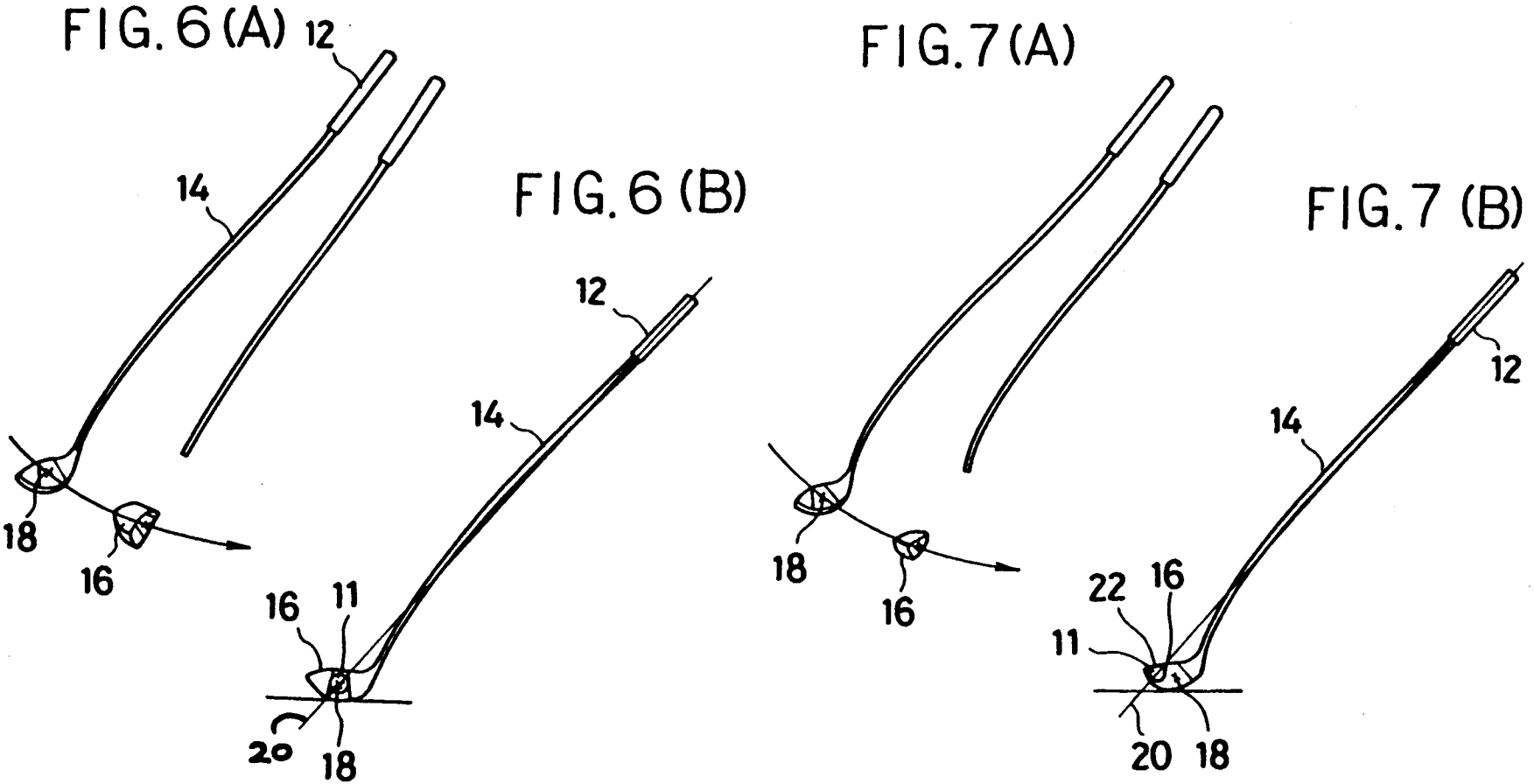
FIGS. 6(A–B) show a plane view of the whip of the club-shaft for optimum impact.
FIGS. 7(A–B) show a club-shaft with excessive whip.
Figure 8:
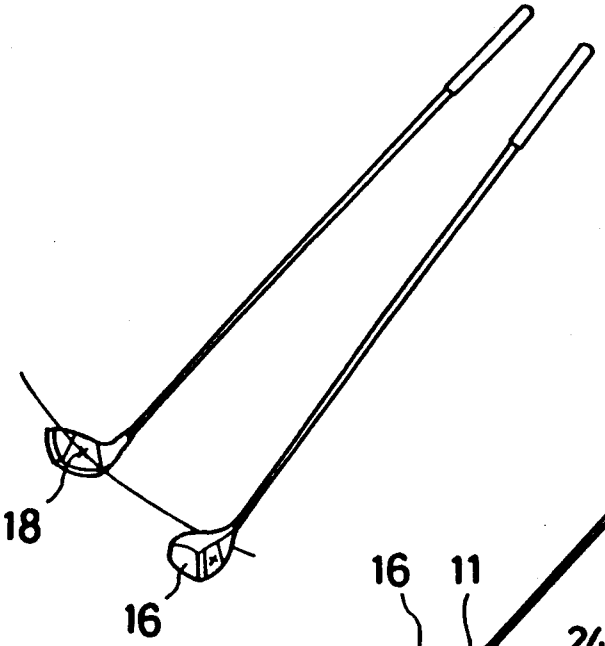
FIGS. 8(A–B) show a club-shaft with insufficient whip.
Figure 8:
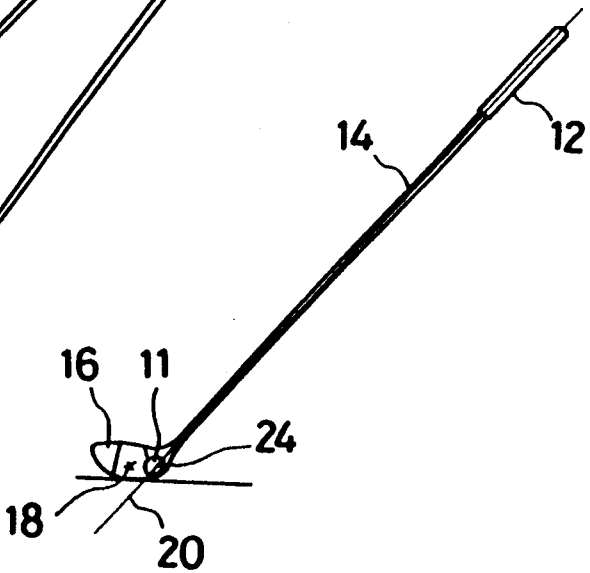

With reference to FIG. 4, which is a plane view of the whip at the kick-point 40 of the club-shaft 14 at the position B, D, E and F. As shown in FIG. 4, when the club-shaft 14, which is comprised of an elastic tube, is swung, at a number of places there are points which bend considerably and portions which barely bend at all; the points at which there is considerable bending are termed kick-points. In any one club-shaft, the kick-points do not change, irrespective of the swing speed. Therefore, it is possible at the kick-points to limit the whip of the club-shaft 14 by providing in the club-shaft cylindrical members formed with slight differences, effectively correcting excessive whip of the club-shaft. The positions of the kick-points can be determined in a same way as with the conventional bending meter, the by offsetting upper-edge fulcrums and lower-edge fulcrums and measuring the degree of bend when the lower-edge fulcrum is held up to form an angle on the order of two degrees. In the embodiment of FIG. 2A, the cylindrical member 30*a* at the grip 12 portion has a non-tapered portion similar to the cylindrical member 30 of FIG. 1A, and a straight tapered portion, but this is not limitative. As shown in FIG. 2B, the cylindrical member at the grip 12 portion may be formed in the shape of the cylindrical member 30*b* which has a curving taper that runs from the terminal end portion of the grip toward the other end, so that as shown in FIG. 2C, whip at the terminal end portion is limited by the extent of the curving taper of the cylindrical member 30*b*. The cylindrical members that are internally affixed at the kick-points are also not limited to the shape disclosed in FIG. 1, and may be formed as a follow spindle member as shown in FIG. 3. Using a spindle-type cylindrical member enables the whip of the portions of the club-shaft that are in front of and behind the cylindrical member to be controlled, as shown in the drawing, enabling the club-shaft to be limited to the ideal whippiness with a small number of cylindrical members.

As has been described in the foregoing, with the balance shaft according to this invention, cylindrical members having a slight taper are fixedly provided within the club-shaft, and within the limited range a high elasticity is imparted which is unaffected by whether the swing speed is faster or slower or the temperature higher or lower, enabling the ideal whip at the moment of impact to be produced; and, regardless of the weight of the club-head, if the swing describes the correct path, the ideal whip for the optimum impact can be produced, allowing all players to compete under the same conditions.

I claim:

1. A golf club, comprising a balance shaft having a first and a second end, a club head attached to the first end and a grip attached to the second end, said balance shaft comprising a hollow tubular club-shaft having an inner diameter, and at least one substantially cylindrical member within the club-shaft, each of said at least one cylindrical member having a tapered surface so as to form a large-diameter portion and a small-diameter end, only the large-diameter portion being fixed to the club-shaft, the small-diameter end having a diameter smaller than the inner diameter of the club-shaft and being located closer to the first end than is said large-diameter portion; so that, when said hollow tubular club-shaft bends during operation an inner surface of said tubular club-shaft contacts said tapered surface of said at least one cylindrical member to control the whippiness of said golf club.

2. A golf club as claimed in claim 1, wherein said large-diameter portion of each of said at least one cylindrical member is located at an end opposing said small-diameter end.

3. A golf club as claimed in claim 1, wherein said large-diameter portion of each of said at least one cylindrical member is located in a center portion of the cylindrical member, and each of said at least one cylindrical member is tapered so as to further comprise a second small-diameter end located at an end opposing the first small-diameter end.

4. A golf club as claimed in claim 1, wherein each of said at least one cylindrical member is made of a high-tensile non-elastic material.

5. A golf club as claimed in claim 1, wherein the club-shaft has a kick-point and a grip portion, and wherein the club comprises one of said cylindrical members located at the kick point and one of said cylindrical members located at the grip portion.

* * * * *